US009846380B2

(12) United States Patent
Tajiri et al.

(10) Patent No.: US 9,846,380 B2
(45) Date of Patent: Dec. 19, 2017

(54) IMAGE FORMING APPARATUS THAT ADJUSTS RELATIVE POSITIONS OF IMAGES BY DETECTING TEST PATTERN

(71) Applicant: CANON KABUSHIKI KAISHA, Tokyo (JP)

(72) Inventors: Tsuyoshi Tajiri, Tokyo (JP); Takehiro Kishi, Toride (JP); Hirotoshi Tajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/222,246

(22) Filed: Jul. 28, 2016

(65) Prior Publication Data

US 2017/0038718 A1 Feb. 9, 2017

(30) Foreign Application Priority Data

Aug. 3, 2015 (JP) ..... 2015-153517

(51) Int. Cl.
*G03G 15/00* (2006.01)
*G03G 15/01* (2006.01)

(52) U.S. Cl.
CPC ..... *G03G 15/0131* (2013.01); *G03G 15/0189* (2013.01); *G03G 15/5058* (2013.01); *G03G 15/6591* (2013.01)

(58) Field of Classification Search
CPC ..... G03G 2215/0161; G03G 15/5058; G03G 15/0131; G03G 15/0189
See application file for complete search history.

(56) References Cited

U.S. PATENT DOCUMENTS

2010/0189448 A1* 7/2010 Fujiki ..... G03G 15/0131 399/16
2013/0142549 A1* 6/2013 Itoh ..... G03G 15/01 399/301

FOREIGN PATENT DOCUMENTS

JP 2006-171352 A 6/2006
JP 2013-025128 A 2/2013

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a detection unit configured to detect a test pattern formed on an image carrier by image forming units; and an adjustment unit configured to control the image forming units to form the test pattern, and adjust relative positions of images based on a detection result of the test pattern. The adjustment unit is further configured to control the image forming units to form the test pattern after the image forming units have formed on the image carrier an image to be transferred to a sheet with a basis weight less than a threshold, and before the image forming units form on the image carrier an image to be transferred to a sheet with a basis weight greater than the threshold.

15 Claims, 11 Drawing Sheets

IMAGE FORMING APPARATUS THAT ADJUSTS RELATIVE POSITIONS OF IMAGES BY DETECTING TEST PATTERN

BACKGROUND OF THE INVENTION

Field of the Invention

The present invention relates to control of correction of positions of images formed on an image carrier.

Description of the Related Art

In image forming apparatuses using an electrophotographic method, a temperature increase caused by continuous image formation and the expansion/contraction of components caused by, for example, fluctuations in the environmental temperature lead to the occurrence of color misregistration, which is misalignment of relative positions of images of different colors used in image formation. In view of this, the image forming apparatuses form a test pattern that is used to detect a misregistration amount on an image carrier, and perform misregistration correction to reduce misregistration based on the result of the detection of the test pattern.

Misregistration correction is started based on a period over which an image forming apparatus operated continuously, and/or the number of recording mediums on which images have been formed. Japanese Patent Laid-Open No. 2013-25128 discloses a configuration in which, to perform misregistration correction during image formation, the image formation is temporarily suspended, an interval to the next recording medium (hereinafter referred to as a paper interval) is increased, and misregistration correction is performed by forming a test pattern in the increased interval. Japanese Patent Laid-Open No. 2006-171352 discloses a configuration in which, to perform misregistration correction during continuous image formation, a test pattern that fits within a paper interval is formed.

The configuration described in Japanese Patent Laid-Open No. 2013-25128 lowers the productivity of image formation because image formation is suspended each time misregistration correction is performed. With the configuration described in Japanese Patent Laid-Open No. 2006-171352, misregistration correction is performed while image formation is in operation. With this configuration, if a recording medium enters a nip region between a secondary transfer unit, such as a secondary transfer roller, and an intermediate transfer belt, the speed of the intermediate transfer belt could possibly deviate from a target speed. If misregistration correction is performed in a state where the speed of the intermediate transfer belt differs from the target speed, misregistration of relative positions of images cannot be corrected with high precision.

SUMMARY OF THE INVENTION

According to an aspect of the present invention, an image forming apparatus includes an image forming unit configured to form an image by overlapping a first image and a second image, the image forming unit including a first image forming unit configured to form the first image using toner of a first color, and a second image forming unit configured to form the second image using toner of a second color that is different from the first color; an image carrier configured to carry the image formed by the image forming unit; a transfer unit configured to transfer the image carried by the image carrier to a sheet; a detection unit configured to detect a test pattern including a first detection image and a second detection image that have been formed on the image carrier by the first image forming unit and the second image forming unit, respectively; and an adjustment unit configured to control the first image forming unit and the second image forming unit to form the test pattern, and adjust relative positions of the first image and the second image based on a detection result of the test pattern by the detection unit. The adjustment unit is further configured to control the image forming unit to form the test pattern after the image forming unit has formed on the image carrier an image to be transferred to a sheet with a basis weight less than a threshold, and before the image forming unit forms on the image carrier an image to be transferred to a sheet with a basis weight greater than the threshold.

Further features of the present invention will become apparent from the following description of exemplary embodiments with reference to the attached drawings.

DESCRIPTION OF THE EMBODIMENTS

Figure 1:
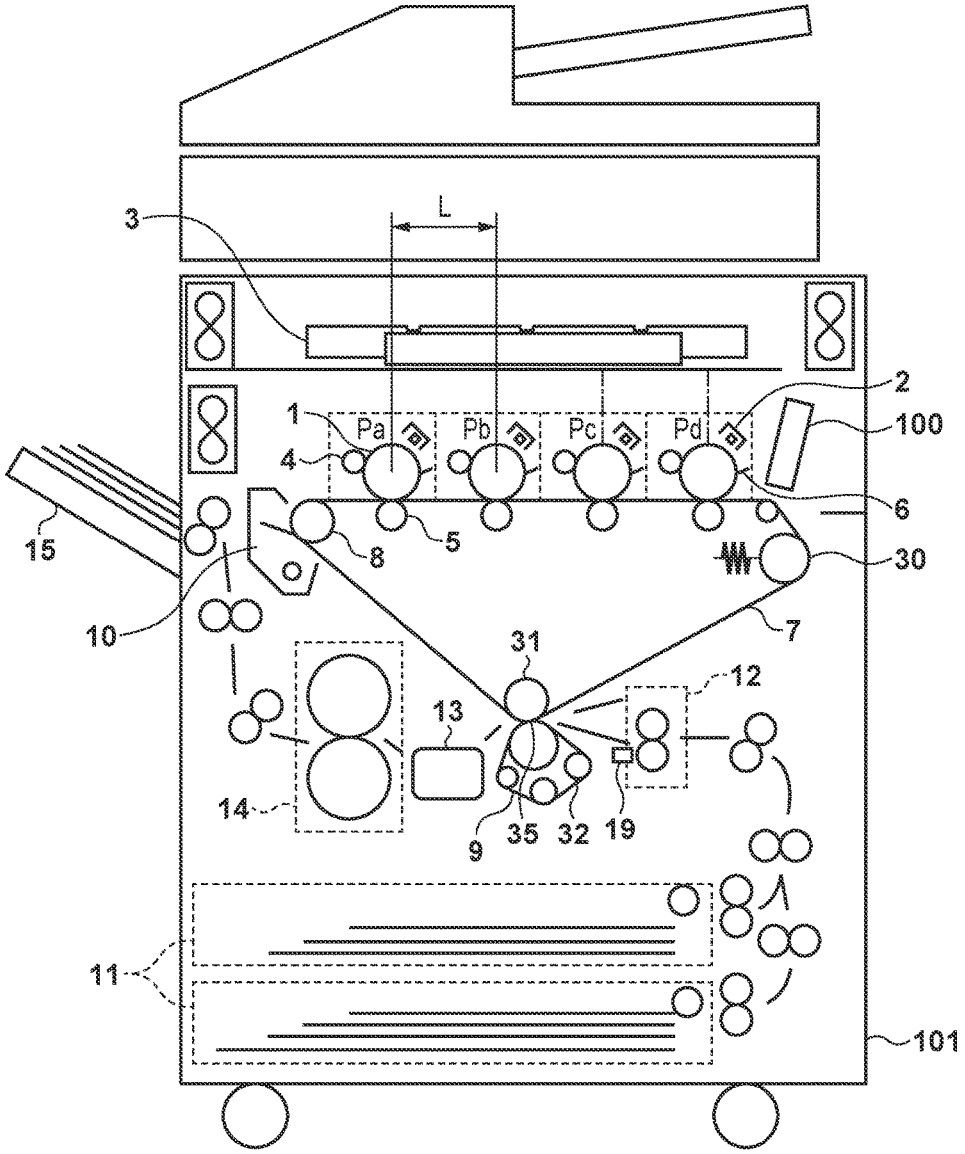
FIG. 1 shows a schematic configuration of an image forming apparatus according to an embodiment.

The following describes exemplary embodiments of the present invention with reference to the drawings. Note that the following embodiments serve as examples, and are not intended to limit the present invention to the contents thereof. Furthermore, constituents that are not necessary for the description of the embodiments are omitted in the drawings described below.

First Embodiment

FIG. 1 shows a schematic configuration of an image forming apparatus 101 according to the present embodiment. Image forming units Pa, Pb, Pc, and Pd form yellow, cyan, magenta, and black toner images, respectively, on an intermediate transfer belt 7. Note that the image forming units Pa, Pb, Pc, and Pd are configured in the same manner, and differ from one another only in the colors of toner they use; therefore, they will hereinafter be described collectively. First of all, a photosensitive member 1 is an image carrier, and is driven and rotated during image formation. The photosensitive member 1 is charged by a charger 2 to have a uniform electric potential. An exposure unit 3 forms an electrostatic latent image on the photosensitive member 1 by scanning the charged photosensitive member 1 with light, that is to say, exposing it to light. A developer 4 forms a toner image by developing the electrostatic latent image formed on the photosensitive member 1 using toner. A primary transfer unit 5 transfers the toner image formed on the photosensitive member 1 to the intermediate transfer belt 7. A cleaner 6 removes toner that has not been transferred to the intermediate transfer belt 7 and thus remained on the photosensitive member 1.

The intermediate transfer belt 7 is an image carrier that is hung in a stretched state by a tension roller 30, a secondary transfer opposite roller 31, and a driving roller 8, and is rotated in conformity to the rotation of the driving roller 8 during image formation. The intermediate transfer belt 7 has a nip region 35 in which the intermediate transfer belt 7 is in contact with a secondary transfer belt 9. Along with the rotation of the intermediate transfer belt 7, toner images transferred to the intermediate transfer belt 7 are conveyed to the nip region 35. Meanwhile, a sheet, or a recording medium, is fed from cassettes 11 and conveyed to the nip region 35 along a conveyance path. When a sensor 19 detects a tip of the sheet, the conveyance of the sheet is temporarily suspended. Thereafter, rollers 12 restart the conveyance of the sheet so that the sheet arrives at the nip region 35 at the time of arrival of the toner images on the intermediate transfer belt 7 to the nip region 35. Note that the nip region 35 is equivalent to a transfer position at which the images are transferred to the sheet.

The secondary transfer belt 9 is hung in a stretched state by a plurality of rollers, and is driven and rotated in conformity to the rotation of a driving roller 32. Note that the driving roller 32 and the driving roller 8 are driven by different driving sources. Here, a transfer member that is driven and rotated is not limited to the secondary transfer belt 9, and may be a roller. A moving speed Vb of a surface of the intermediate transfer belt 7 is set to be higher than a moving speed Vtr of a surface of the secondary transfer belt 9 in order to improve the transfer characteristic of transfer to the sheet. That is to say, the relationship Vb>Vtr holds.

When supplied with a transfer voltage from a non-illustrated power unit, the secondary transfer belt 9 transfers the toner images on the intermediate transfer belt 7 to the sheet. A cleaner 10 removes toner that has not been transferred to the sheet and thus remained on the intermediate transfer belt 7. A conveyance belt 13 conveys the sheet to which the toner images have been transferred to a fixing unit 14. The fixing unit 14 fixes the toner images onto the sheet by heating and pressurizing the sheet. Thereafter, the sheet is discharged to a discharge tray 15 outside the apparatus. The image forming apparatus 101 also includes a detection unit 100 that detects a test pattern formed on the intermediate transfer belt 7 during misregistration correction. The detection unit 100 includes an LED that illuminates the intermediate transfer belt 7 with light, and a light receiving unit that receives light reflected from the test pattern on the intermediate transfer belt 7, and the detection unit 100 outputs, to a control unit 111 (FIG. 2), a sensor output value based on the intensity of light received by the light receiving unit. Note that the test pattern includes yellow, magenta, cyan, and black detection images.

Figure 2:
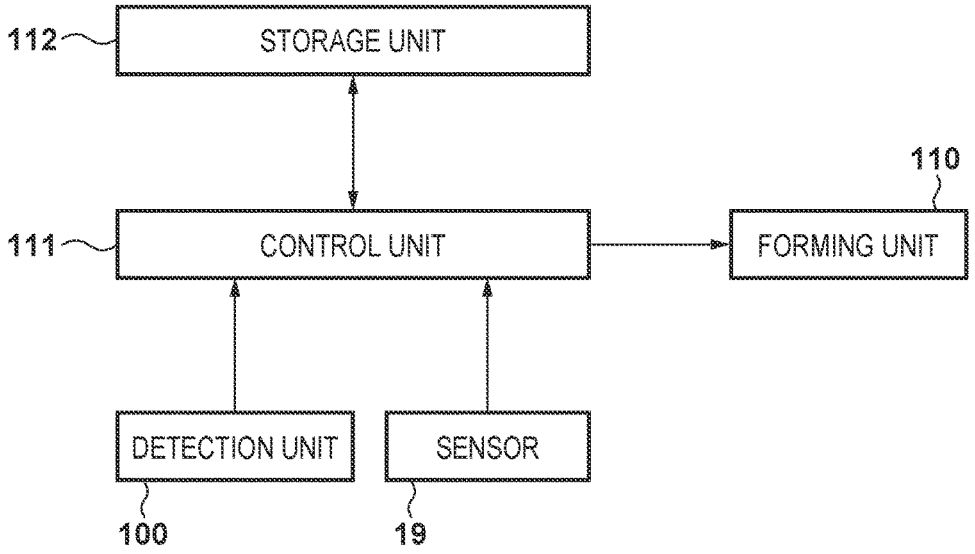
FIG. 2 shows a configuration related to control of an image forming apparatus according to an embodiment.

FIG. 2 shows a configuration related to control of the image forming apparatus. The control unit 111 controls the overall image formation by the image forming apparatus. The control unit 111 also determines whether it is necessary to perform misregistration correction. To cause the image forming apparatus to perform misregistration correction, the control unit 111 forms a test pattern on the intermediate transfer belt 7, obtains the detection result from the detection unit 100, and obtains the relative misregistration amounts of images of different colors based on the detection result. Then, based on the obtained misregistration amounts, the control unit 111, for example, adjusts the timings to form electrostatic latent images on the photosensitive members 1 so as to reduce misregistration. Note that in FIG. 2, a forming unit 110 represents the image forming units Pa, Pb, Pc, and Pd shown in FIG. 1. A storage unit 112 stores attribute information of sheets. For example, the storage unit 112 stores basis weights of the sheets. That is to say, the storage unit 112 stores information indicating the relationship between the sheets and the basis weights of the sheets.

Figure 3:
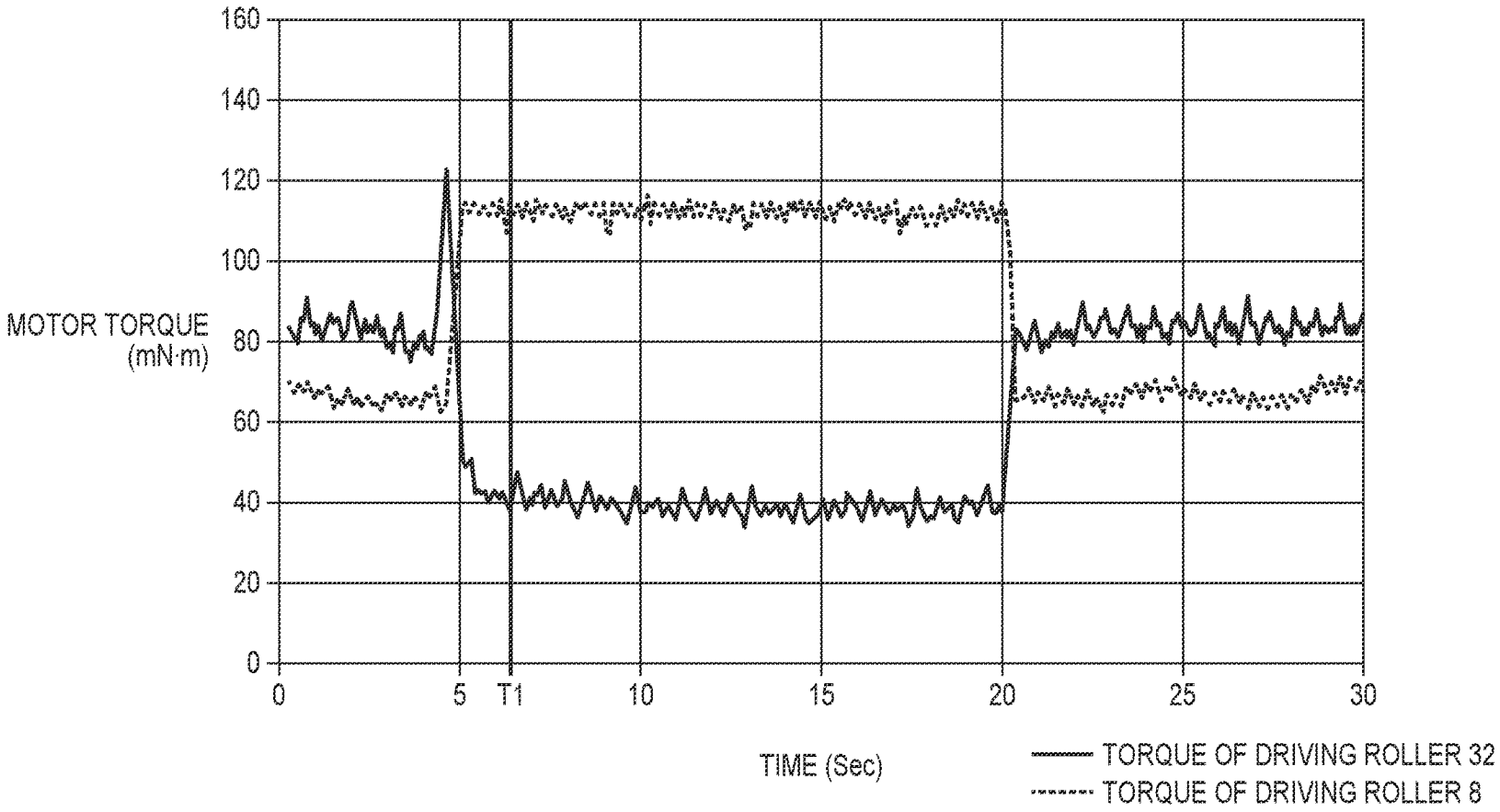
FIG. 3 shows fluctuations in torques of driving rollers associated with a basis weight.
Figure 4:
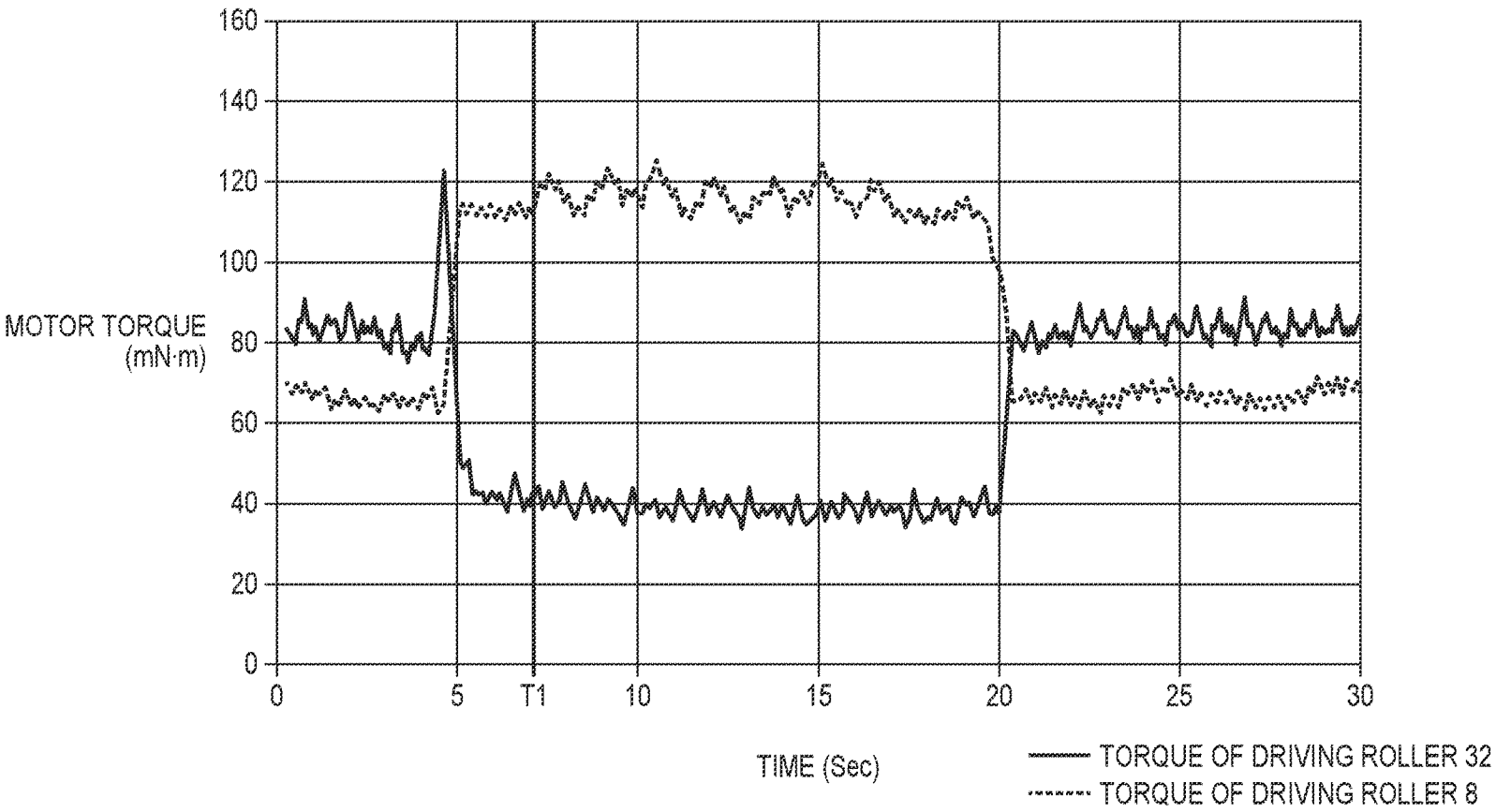
FIG. 4 shows fluctuations in torques of driving rollers associated with a basis weight.

FIG. 3 shows the measurement result of fluctuations in torques of the driving rollers 8 and 32 when toner images have been transferred to a sheet with a basis weight of 128 g/m$^3$. FIG. 4 shows the measurement result of fluctuations in torques of the driving rollers 8 and 32 when images have been transferred to a sheet with a basis weight of 350 g/m$^3$. Note that the size of the recording medium is A3 in both cases. Furthermore, at the time of the measurement, the moving speed Vb of the surface of the intermediate transfer belt 7 is set to be higher than the moving speed Vtr of the surface of the secondary transfer belt 9 as mentioned earlier. In FIGS. 3 and 4, time T1 denotes time when a tip of the sheet starts to enter the nip region 35. As shown in FIG. 3, in the case of the sheet with a basis weight of 128 g/m$^3$, the entry of the sheet into the nip region 35 does not cause any torque fluctuation. On the other hand, as shown in FIG. 4, in the case of the sheet with a basis weight of 350 g/m$^3$, the driving roller 8 that drives the intermediate transfer belt 7 is subjected to large torque fluctuations after the sheet enters the nip region 35. Such torque fluctuations could possibly cause the intermediate transfer belt 7 to slip with respect to the driving roller 8. If the intermediate transfer belt 7 slips, the speed of the surface of the intermediate transfer belt 7 deviates from the target speed.

Figure 5:
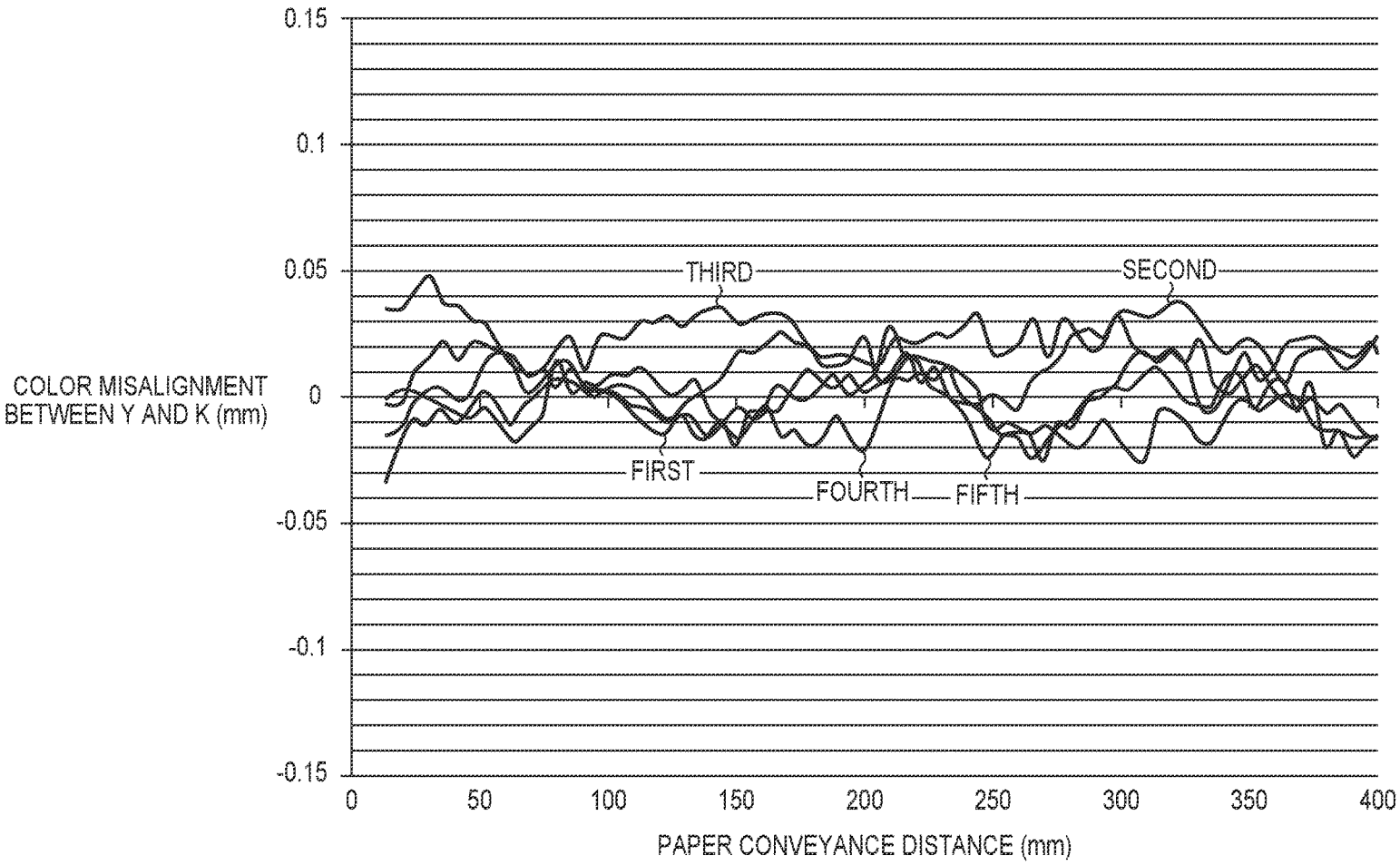
FIG. 5 shows misregistration amounts associated with a basis weight.
Figure 6:
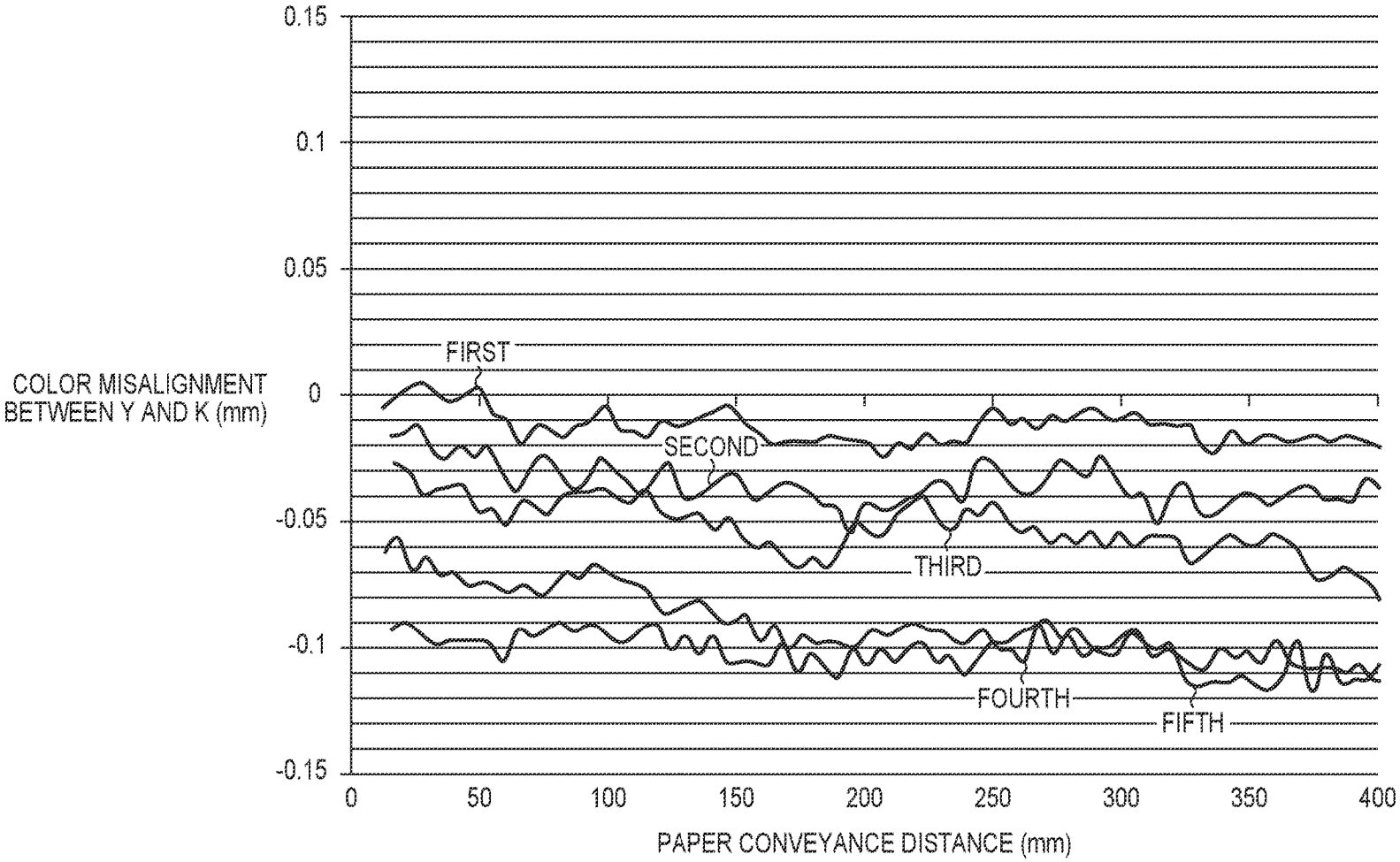
FIG. 6 shows misregistration amounts associated with a basis weight.
Figure 7:
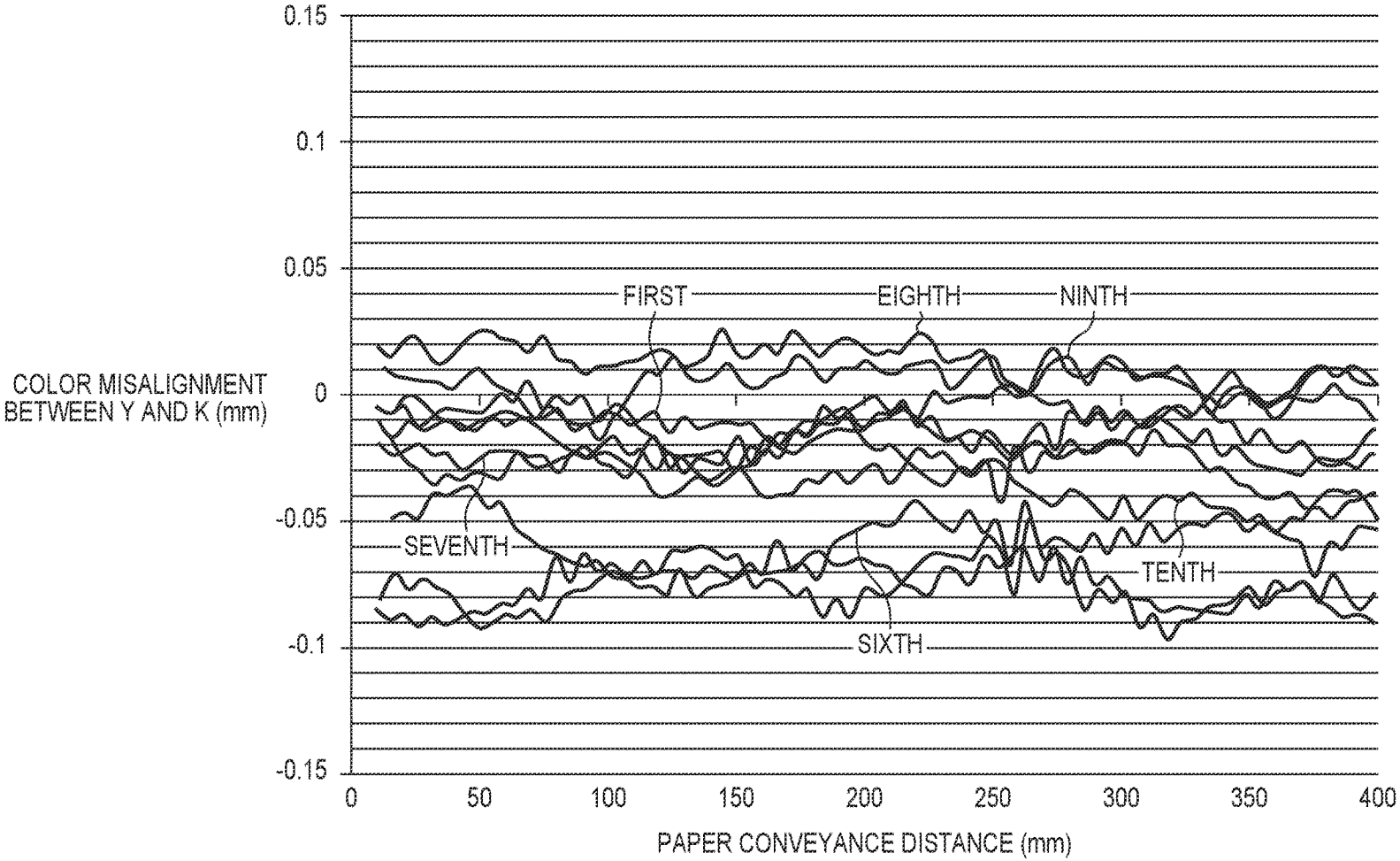
FIG. 7 shows misregistration amounts associated with a basis weight.

FIG. 5 shows the measurement result of the misregistration amounts of black (K) with respect to yellow (Y) when images have been formed continuously on five A3 sheets with a basis weight of 128 g/m$^3$. FIG. 6 shows the measurement result of the misregistration amounts of black (K) with respect to yellow (Y) when images have been formed continuously on five A3 sheets with a basis weight of 350 g/m$^3$. FIG. 7 shows the measurement result of the misregistration amounts of black (K) with respect to yellow (Y) when images have been formed continuously on ten A3 sheets with a basis weight of 350 g/m$^3$. At the time of the measurement shown in FIG. 7, the paper interval between the sixth and seventh sheets is increased compared with other paper intervals. Note that in the image forming apparatus, when the first sheet enters the nip region 35, the intermediate transfer belt 7 carries toner images to be transferred to the third sheet.

As is apparent from FIG. 5, in the case of sheets with a relatively small basis weight of 128 g/m$^3$, there is no large difference among the misregistration amounts of images formed on five sheets. On the other hand, as shown in FIG. 6, in the case of sheets with a large basis weight of 350 g/m$^3$, the misregistration amounts on the fourth and fifth sheets are larger than the misregistration amount on the first to third sheets. This is attributed to torque fluctuations caused by the entry of the sheets into the nip region 35. In FIG. 7, due to the increased paper interval between the sixth and seventh sheets, the misregistration amount on the seventh sheet is not much different from the misregistration amount on the first sheet. This is because, due to the increased paper interval, fluctuations in the moving speed Vb of the surface of the intermediate transfer belt 7 caused by the torque fluctuations have been subdued when images to be transferred to the seventh sheet are formed on the intermediate transfer belt 7. Furthermore, as images to be transferred to the ninth sheet are already transferred to the intermediate transfer belt 7 before the seventh sheet enters the nip region 35, the misregistration amounts on the eighth and ninth sheets are not much different from the amount of color misalignment on the first sheet. However, the misregistration amount of images on the tenth sheet is large due to the influence of the entry of the seventh sheet into the nip region 35. Note that the intermediate transfer belt 7 is controlled so that the moving speed of its surface matches a predetermined speed. That is to say, the driving roller 8 is controlled to achieve a predetermined moving speed, regardless of the basis weights of sheets to which images carried by the intermediate transfer belt 7 are to be transferred.

In view of the above, depending on the basis weights of sheets P, the image forming apparatus controls misregistration correction that is performed during continuous formation of a plurality of images. For example, when all of the basis weights of sheets on which images designated by a print job are to be formed are equal to or smaller than a threshold, the control unit 111 performs misregistration correction by forming a test pattern in a paper interval without suspending the print job. That is to say, while forming images to be transferred to sheets on the intermediate transfer belt 7, the control unit 111 performs misregistration correction by forming a test pattern on the intermediate transfer belt 7 in a region between the images to be transferred to the sheets. Note that misregistration correction may be performed without suspending a print job if all of the basis weights of sheets to which the images satisfying the following condition are to be transferred are equal to or smaller than the threshold: image formation is performed on the photosensitive members 1 after the control unit 111 has determined that misregistration correction is necessary. On the other hand, if any of the basis weights of sheets on which images designated by a print job are to be formed is larger than the threshold, the control unit 111 performs misregistration correction while the print job is suspended. Specifically, after images to be transferred to a sheet with a basis weight larger than the threshold are formed on the intermediate transfer belt 7, the print job is suspended and a test pattern is formed. Then, misregistration correction is performed based on the detection result of the test pattern. After completion of misregistration correction, the control unit 111 restarts the print job. The foregoing configuration maintains the precision of misregistration correction when a sheet enters the nip region 35. Although the threshold is hereinafter set to 128 g/m$^3$, the threshold is not limited to such a particular value. More specifically, the threshold can be determined based on a basis weight that starts to influence misregistration correction due to fluctuations in the moving speed of the surface of the intermediate transfer belt 7 caused by the entry of a sheet into the nip region 35.

Figure 8A:
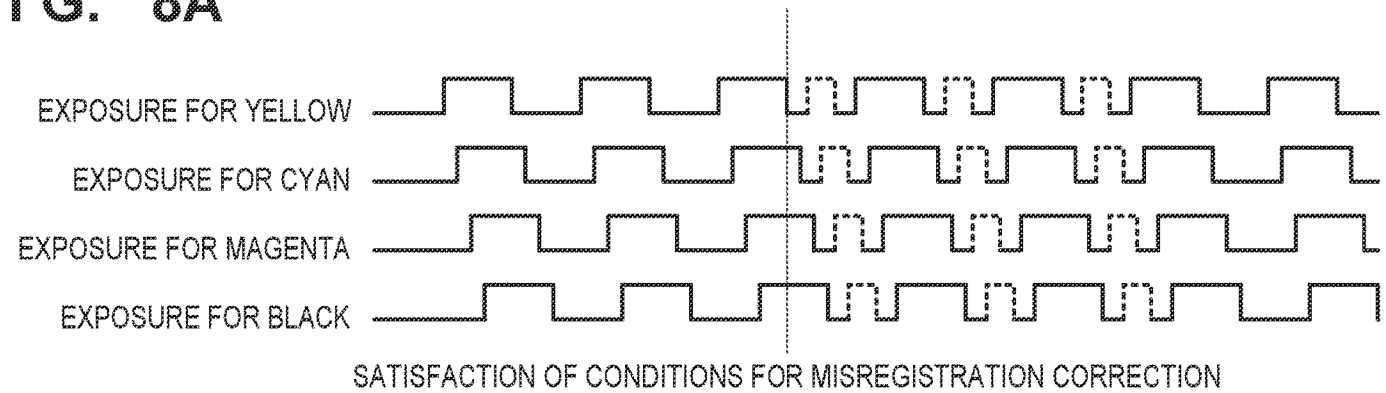
FIGS. 8A and 8B are timing charts showing exposure processing according to an embodiment.
Figure 8B:
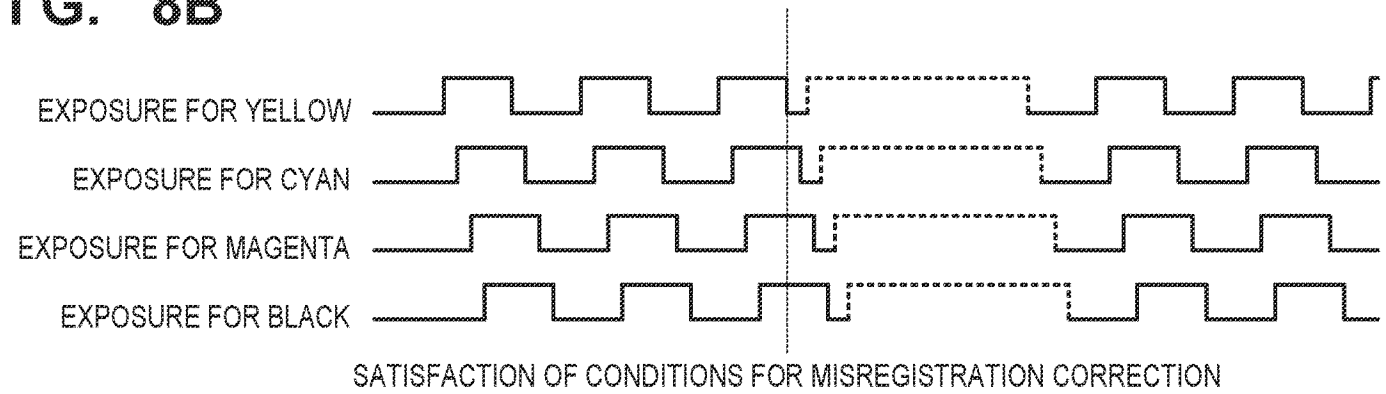

FIGS. 8A and 8B are timing charts showing the operations of the exposure units 3 for each color in misregistration correction according to the present embodiment. Note that FIG. 8A depicts a case in which the basis weights of sheets designated by a print job issued by a user's instruction are equal to or smaller than 128 g/m$^3$, whereas FIG. 8B depicts a case in which at least one of the basis weights of sheets designated by a print job is larger than 128 g/m$^3$. Here, the relationship between the types and basis weights of the sheets is stored in advance as the attributed information of the sheets in the storage unit 112. In FIGS. 8A and 8B, high-level periods are periods in which the photosensitive members 1 are exposed to light to form electrostatic latent images thereon. Furthermore, among the high-level periods, periods indicated by solid lines are periods in which exposure is performed to form images to be transferred to the sheets, whereas periods indicated by dot lines are periods in which exposure is performed to form test patterns. Upon the start of image formation, each exposure unit 3 starts to expose the corresponding photosensitive member 1 to light. Note that in the present embodiment, as shown in FIG. 1, the photosensitive members 1 for yellow, cyan, magenta, and black are arranged in this order, with the photosensitive member 1 for yellow being most upstream in the direction of movement of the intermediate transfer belt 7. Therefore, the timings at which the exposure units 3 for yellow and cyan expose the corresponding photosensitive members 1 to light differ from each other by a pitch period. The pitch period is obtained by dividing a distance L between two neighboring photosensitive members 1 in FIG. 1 by a process speed, that is to say, the moving speed Vb of the surface of the intermediate transfer belt 7.

If a controller determines that misregistration correction is necessary on satisfaction of predetermined conditions, in the case of FIG. 8A, a test pattern for misregistration correction is formed in a paper interval without suspending the print job. On the other hand, in the case of FIG. 8B in which at least one of the basis weights of the sheets to be printed is larger than 128 g/m$^3$, a test pattern is formed while the print job is temporarily suspended. This test pattern may be the same as or different from the test pattern that is formed in a paper interval without suspending the print job. If the former is different from the latter, the former may be longer than the latter in the direction of movement of the surface of the intermediate transfer belt 7. Such a longer test pattern can improve the precision of misregistration correction. In the case of FIG. 8B, upon completion of misregistration correction, the print job, that is to say, formation of images to be transferred to the sheets, is restarted.

Figure 9:
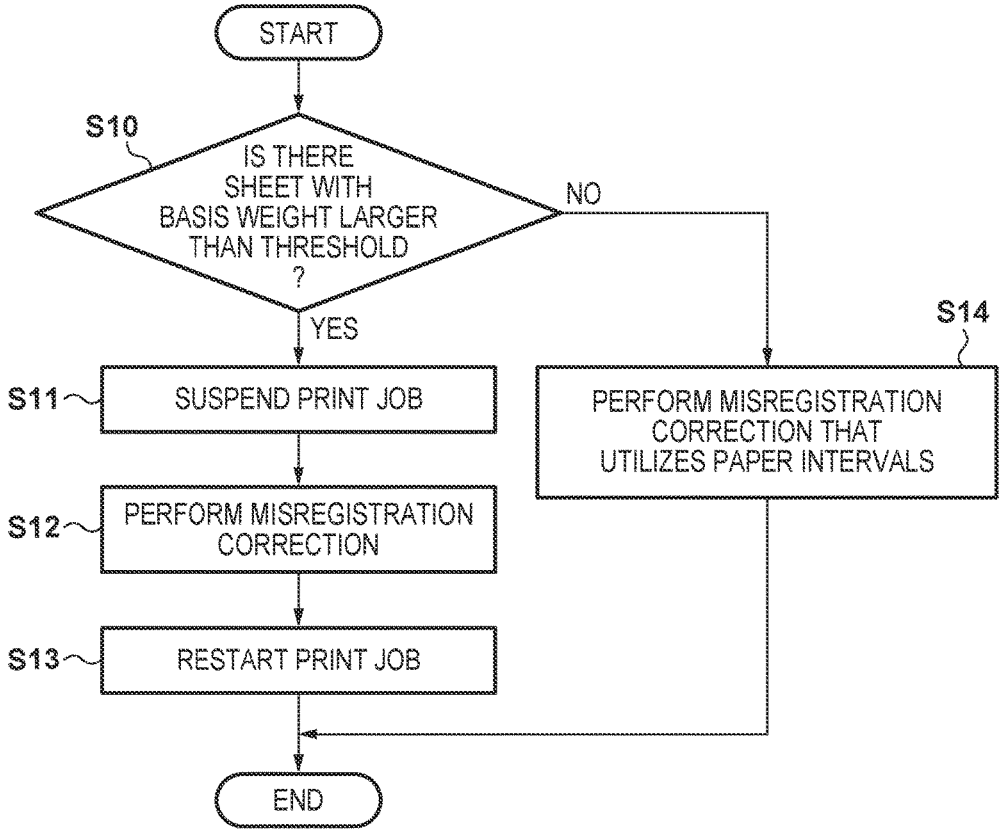
FIG. 9 is a flowchart of processing executed by a control unit according to an embodiment.

FIG. 9 is a flowchart of processing executed by the control unit 111 in the present embodiment. The control unit 111 starts the processing of FIG. 9 if it determines that misregistration correction is necessary during image formation based on a print job. Note that the control unit 111 determines whether misregistration correction is necessary based on whether the states of the image forming apparatus satisfy predetermined conditions. More specifically, the image forming apparatus starts misregistration correction when, for example, the following elements have reached predetermined values: an amount of change in the internal temperature since the last misregistration correction; the number of printed sheets or an elapsed period since the start of image formation based on the print job; and the cumulative number of printed sheets or a cumulative elapsed period since power ON.

First, in step S10, the control unit 111 determines whether at least one of the basis weights of sheets to be printed based on the print job is larger than the threshold. If none of the basis weights is larger than the threshold, misregistration correction that utilizes paper intervals is performed in step S14. That is to say, misregistration correction is performed without suspending the print job. On the other hand, if the print job includes printing on at least one sheet with a basis weight larger than the threshold, the control unit 111 suspends the print job, that is to say, temporarily suspends image formation processing, after forming images to be transferred to the sheet with the basis weight larger than the threshold in step S11. Then, the control unit 111 performs misregistration correction by forming a test pattern on the intermediate transfer belt 7 in step S12. After completion of misregistration correction, the control unit 111 restarts the print job, that is to say, formation of images to be formed on the sheets, in step S13.

Second Embodiment

A description is now given of a second embodiment, with a focus on differences from the first embodiment. In the present embodiment, the sensor 19 is configured to detect the basis weights of sheets. Based on the result of the detection by the sensor 19, the control unit 111 determines whether to perform misregistration correction without suspending a print job, or to perform misregistration correction while the print job is suspended.

Figure 10:
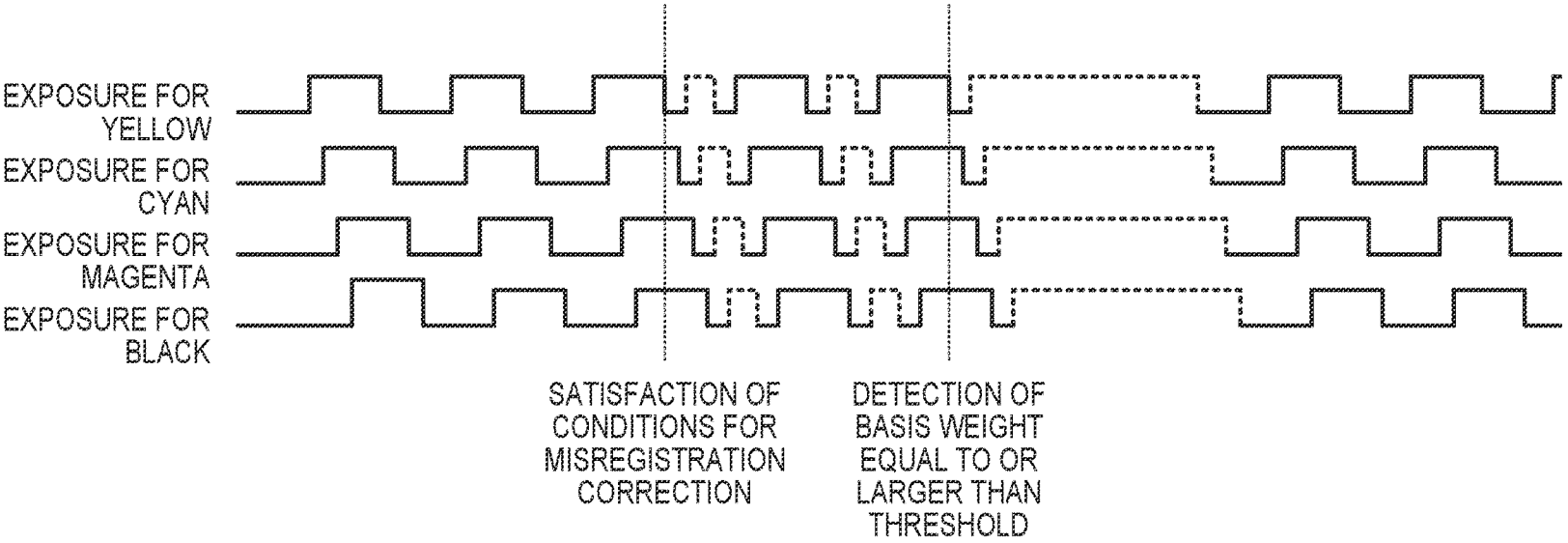
FIG. 10 is a timing chart showing exposure processing according to an embodiment.

FIG. 10 is a timing chart showing the operations of the exposure units 3 for each color in misregistration correction according to the present embodiment. Note that this figure is illustrated in a manner similar to FIG. 8A. Upon the start of image formation, each exposure unit 3 starts to expose the corresponding photosensitive member 1 to light. If the controller determines that misregistration correction is necessary on satisfaction of predetermined conditions, the control unit 111 determines whether it is necessary to suspend the print job based on the basis weight detected by the sensor 19, specifically, the basis weight of a sheet that is to enter the nip region next. In FIG. 10, image formation is performed for two sheets after the start of misregistration correction. However, as the sensor 19 detects the basis weight larger than the threshold, image formation is suspended for the third sheet after the start of misregistration correction, and then misregistration correction is performed. Similarly to the first embodiment, the control unit 111 restarts the print job upon completion of misregistration correction.

Figure 11:
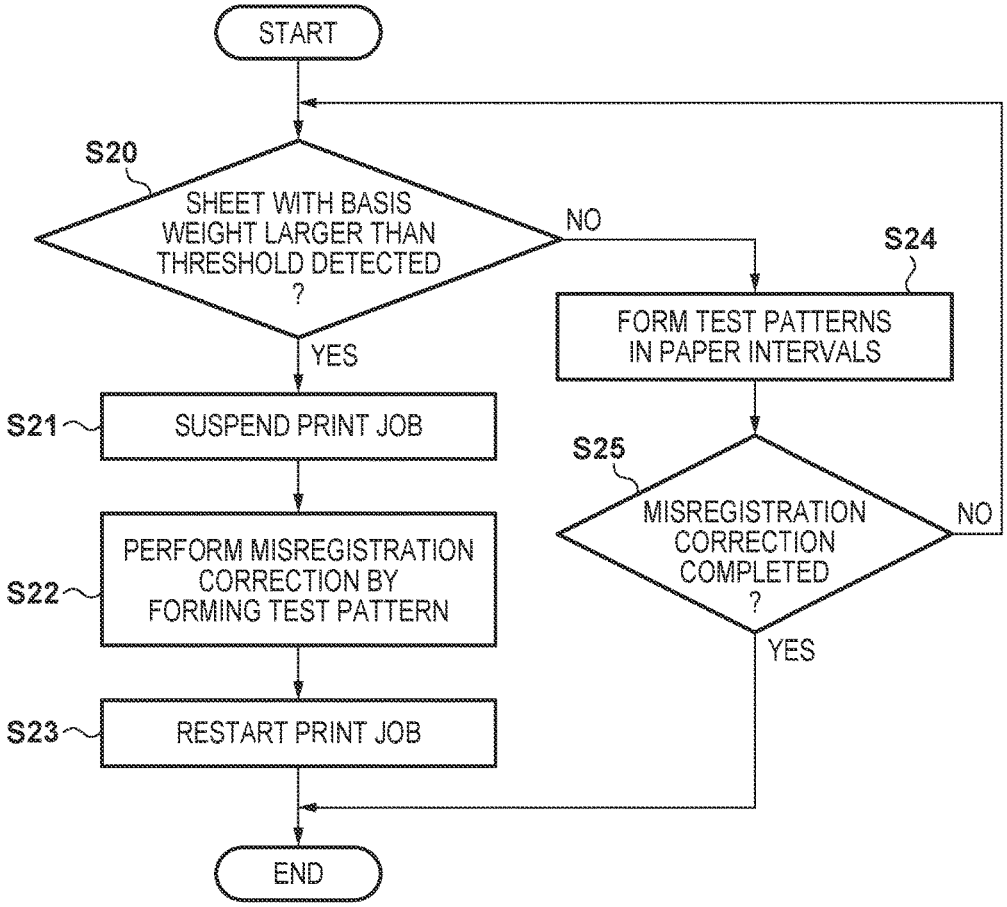
FIG. 11 is a flowchart of processing executed by a control unit according to an embodiment.

FIG. 11 is a flowchart of processing executed by the control unit 111 in the present embodiment. The control unit 111 starts the processing of FIG. 11 if it determines that misregistration correction is necessary during image formation based on a print job. Once the control unit 111 has started misregistration correction during the print job, it determines whether the sensor 19 has detected a sheet with a basis weight larger than the threshold in step S20. If such a sheet has not been detected, the control unit 111 performs misregistration correction by forming test patterns in paper intervals without suspending the print job in step S24. In this case, the control unit 111 determines whether misregistration correction has been completed in step S25, and repeats the processing from step S20 if misregistration correction has not been completed. In misregistration correction that forms test patterns in paper intervals, image forming positions are corrected by averaging the detection results of test patterns formed in at least two paper intervals. Therefore, the control unit 111 does not determine that misregistration correction has been completed until the detection unit 100 detects test patterns formed in at least two paper intervals. If misregistration correction is completed before the sensor 19 detects a sheet with a basis weight larger than the threshold, the control unit 111 ends the processing. On the other hand, the control unit 111 suspends the print job in step S21 if a sheet with a basis weight larger than the threshold is detected in step S20 after the start of misregistration correction, or if a basis weight larger than the threshold is detected in step S20 before completion of misregistration correction that utilizes test patterns formed in paper intervals. Then, the control unit 111 performs misregistration correction by forming a test pattern on the intermediate transfer belt 7 in step S22, and restarts the print job in step S23 upon completion of misregistration correction.

The above-described embodiments use a basis weight as a criterion to determine whether to perform misregistration correction while a print job is suspended, or to perform misregistration correction without suspending the print job. It is also possible to use attribute information that is related to an arbitrary sheet and enables determination of whether the rotation of the intermediate transfer belt 7 is influenced by the entry of a sheet into the nip region 35. Specifically, information indicating the basis weights, thicknesses, and stiffnesses of sheets can be used as attribute information.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-153517, filed on Aug. 3, 2015, which is hereby incorporated by reference herein in its entirety.

What is claimed is:

1. An image forming apparatus, comprising:

a plurality of image forming units configured to form images, each having a different color;

an intermediate transfer member to which the images formed by the plurality of image forming units are transferred, the intermediate transfer member being configured to convey the images;

a detection unit configured to detect a color pattern formed on the intermediate transfer member, the color pattern being used for detecting color misregistration;

a controller configured to:

control the plurality of image forming units to form a first plurality of color patterns, each having a difference color, on the intermediate transfer member, control the detection unit to detect a first amount of color misregistration, related to a relative position of a color pattern having a reference color among the first plurality of color patterns and a color pattern having another color among the first plurality of color patterns, and determine a correction value for adjusting an image write start timing of the other color different from the reference color based on the first amount of color misregistration detected by the detection unit; and an obtaining unit configured to obtain information related to a sheet, wherein the controller is further configured to, in a case where the plurality of image forming units continuously form a first image and a second image that are to be transferred, respectively, to a first sheet and a second sheet based on a print job, control the plurality of image forming units to form a second plurality of color patterns, each having a different color, wherein the second plurality of color patterns are formed in between the first image and the second image on the intermediate transfer member, wherein the controller is further configured to control the detection unit to detect a second amount of color misregistration, related to a relative position of a color pattern having a reference color among the second plurality of color patterns and a color pattern having another color among the second plurality of color patterns, and determine the correction value based on the second amount of color misregistration detected by the detection unit, wherein a basis weight of the first sheet is less than a predetermined basis weight, wherein a basis weight of the second sheet is greater than the predetermined basis weight, and wherein a length of the second plurality of color patterns formed on the intermediate transfer member in a conveyance direction of the images by the intermediate transfer member is longer than a length of the first plurality of color patterns formed on the intermediate transfer member in the conveyance direction.

2. The image forming apparatus according to claim 1, wherein the controller is further configured to control the plurality of image forming units to form the first plurality of color patterns in a case where an amount of change in an internal temperature of the image forming apparatus reaches a predetermined amount.

3. The image forming apparatus according to claim 1, wherein the controller is further configured to control the plurality of image forming units to form the first plurality of color patterns in a case where a number of printed sheets reaches a predetermined number while the plurality of image forming units are continuously forming images on a plurality of sheets.

4. The image forming apparatus according to claim 1, wherein the controller is further configured to control the plurality of image forming units to form the first plurality of color patterns in a case where an elapsed period reaches a predetermined period while the plurality of image forming units are continuously forming images on a plurality of sheets.

5. The image forming apparatus according to claim 1, wherein the controller is further configured to control the plurality of image forming units to form the first plurality of color patterns in a case where an elapsed period since power ON of the image forming apparatus reaches a predetermined period.

6. The image forming apparatus according to claim 1, wherein the controller is further configured to control the plurality of image forming units to form the first plurality of color patterns in a case where a number of printed sheets since power ON of the image forming apparatus reaches a predetermined number.

7. An image forming apparatus, comprising:

a plurality of image forming units configured to form images, each having a different color;

a transfer member to which the images formed by the plurality of image forming units are transferred;

a detection unit configured to detect a color pattern formed on the transfer member, the color pattern being used for detecting color misregistration; and a controller configured to:

control the plurality of image forming units to form a plurality of color patterns, each having a difference color, on the transfer member, control the detection unit to detect an amount of color misregistration, related to a relative position of a color pattern having a reference color among the plurality of color patterns and a color pattern having another color among the plurality of color patterns, and determine an adjustment value for adjusting an image write start timing of the other color different from the reference color based on the amount of color misregistration detected by the detection unit, wherein the controller controls the plurality of image forming units to form a first plurality of color patterns while the plurality image forming units continuously forms first images to be transferred onto a first sheet and second images to be transferred onto a second sheet, controls the detection unit to detect a first amount of color misregistration from the first plurality of color patterns, and determines the adjustment value based on the first amount of color misregistration detected by the detection unit, wherein a basis weight of the first sheet is less than a predetermined basis weight, wherein a basis weight of the second sheet is less than the predetermined basis weight, wherein the controller, in a case where the plurality of image forming units continuously form third images to be transferred onto a third sheet and fourth images to be transferred onto a fourth sheet, controls the plurality of image forming units to form a second plurality of color patterns, controls the detection unit to detect a second amount of color misregistration from the second plurality of color patterns, and determines the adjustment value based on the second amount of color misregistration detected by the detection unit, wherein a basis weight of the third sheet is less than the predetermined basis weight, and wherein a basis weight of the fourth sheet is greater than the predetermined basis weight.

8. The image forming apparatus according to claim 7, wherein the second plurality of color patterns is formed in between the third images and the fourth images on the transfer member.

9. The image forming apparatus according to claim 7, wherein the transfer member conveys the images, and a length of the second plurality of color patterns formed on the transfer member in a conveyance direction of the images by the transfer member is longer than a length of the first plurality of color patterns formed on the transfer member in the conveyance direction.

10. The image forming apparatus according to claim 7, wherein the controller controls the plurality of image forming units to form the first plurality of color patterns in a case where an amount of change in an internal temperature of the image forming apparatus reaches a predetermined amount.

11. The image forming apparatus according to claim 7, wherein the controller controls the plurality of image forming units to form the first plurality of color patterns in a case where a number of printed sheets reaches a predetermined number while the plurality of image forming units are continuously forming images on a plurality of sheets.

12. The image forming apparatus according to claim 7, wherein the controller controls the plurality of image forming units to form the first plurality of color patterns in a case where an elapsed period reaches a predetermined period while the plurality of image forming units are continuously forming images on a plurality of sheets.

13. The image forming apparatus according to claim 7, wherein the controller controls the plurality of image forming units to form the first plurality of color patterns in a case where an elapsed period since power ON of the image forming apparatus reaches a predetermined period.

14. The image forming apparatus according to claim 7, wherein the controller controls the plurality of image forming units to form the first plurality of color patterns in a case where a number of printed sheets since power ON of the image forming apparatus reaches a predetermined number.

15. The image forming apparatus according to claim 7, wherein the transfer member transfers the images onto a sheet, wherein the transfer member includes a belt and a roller around which the belt is suspended, and wherein the transfer member is controlled such that a rotation speed of the roller corresponds to a predetermined rotation speed.

* * * * *